United States Patent [19]

Kimura et al.

[11] 4,194,553

[45] Mar. 25, 1980

[54] COOLING AND GUIDE METHOD AND APPARATUS IN A CONTINUOUS CASTING MACHINE

[75] Inventors: Tomoaki Kimura; Tadashi Nishino, both of Hitachi, Japan

[73] Assignee: Hitachi, Ltd., Tokyo, Japan

[21] Appl. No.: 912,337

[22] Filed: Jun. 5, 1978

[51] Int. Cl.[2] ..... B22D 11/06

[52] U.S. Cl. ..... 164/87; 164/433

[58] Field of Search ..... 164/87, 88, 433, 434

[56] References Cited

U.S. PATENT DOCUMENTS

| | | | |
|---|---|---|---|
| 359,348 | 3/1887 | Daniels | 164/433 X |
| 3,623,535 | 11/1971 | Lenaeus | 164/87 |
| 3,659,643 | 5/1972 | Pauels | 164/416 |
| 4,061,178 | 12/1977 | Sivilotti et al. | 164/87 |

FOREIGN PATENT DOCUMENTS

| | | | |
|---|---|---|---|
| 52-23326 | 6/1977 | Japan | 164/433 |

*Primary Examiner*—Robert D. Baldwin

*Attorney, Agent, or Firm*—Thomas E. Beall, Jr.

[57] ABSTRACT

A method of and apparatus for cooling and guiding a strip of metal discharged from a casting mold into a straightening section of a continuous casting machine in which a casting wheel is provided with a peripheral groove with a portion of its length closed by an endless belt to form the casting mold. A surface of the metal strip on the side of the casting wheel is cooled by a sheet of liquid coolant which flows on the surface and guided by a hydrostatic bearing of the liquid coolant while the metal strip is gradually straightened.

15 Claims, 8 Drawing Figures

COOLING AND GUIDE METHOD AND APPARATUS IN A CONTINUOUS CASTING MACHINE

BACKGROUND OF THE INVENTION

The present invention relates to a method of and apparatus for cooling and guiding metal strips cast by a continuous casting apparatus.

More particularly, the present invention is concerned with a method of and apparatus for cooling and guiding a metal strip which has been cast by and delivered from a casting mold of a continuous casting apparatus, at a straightening section connected to the latter.

More specifically, the method and apparatus of the invention are adapted for use in combination with a continuous casting apparatus of a type generally referred to as "wheel-belt caster" having a casting wheel provided with a peripheral groove adapted to be closed over a portion of its circumferential length by an endless belt, such that the endless belt and the peripheral groove define the casting mold in cooperation with each other.

A casting apparatus called "wheel-belt caster" has been well known as a kind of a continuous casting apparatus for producing continuous metal strips. This wheel-belt caster has a casting wheel provided with a peripheral groove, and a steel endless belt adapted to run in contact with a portion of the circumferential length of the groove, such that the peripheral groove and the steel endless belt in combination define a casting mold.

In operation, a molten metal is poured into the casting mold from an inlet of the latter where the endless steel belt comes into contact with the casting wheel, while a solidified metal strip is continuously delivered from an outlet of the casting mold where the endless steel belt leaves the casting wheel.

In this type of casting apparatus, a straightening section is disposed adjacent to the outlet of the casting mold, for the purpose of straightening the metal strip which assumes a curved configuration soon after the delivery from the casting mold.

The straightening work in this section is usually performed by pinch rollers disposed at the downstream side of the casting mold and adapted to forcibly pull out the solidified metal strip from the latter.

The specification of U.S. Pat. No. 3,659,643 discloses a continuous casting machine in which a casting shoe is used in place of the endless belt of the wheel-belt caster. In this casting machine, the straightening of the case metal strip is effected through forcibly guiding the metal strip by means of a knife-like guiding plate disposed adjacent to the outlet of the casting mold.

However, these conventional straightening methods have suffered various problems as explained below, especially in case of casting of metals having low thermal conductivities such as steel and the like. At the same time, it has been pointed out that, in case of the straightening method relying upon the knife-shaped guide plate, the edge and the guide surface of the guide plate is worn down impractically soon.

The inconveniences caused in the course of straightening of the metal strips having low thermal conductivities, cast by the aforementioned type of a continuous casting apparatus, are as follows.

When the metal to be straightened is, for example, copper whose thermal conductivity is as high as about 330 Kcal/mh° C., the heat possessed by the strip is transferred to the mold walls in a relatively short time, and the strip has been solidified substantially to the core thereof when pulled out from the casting mold, so that the straightening can be carried out without substantial difficulty or problem. However, when the metal is such one as having a low thermal conductivity, e.g. a steel whose thermal conductivity is as low as 29 Kcal/mh° C., the metal strip has been solidified only to the depth of about 10 mm or so from the surface, when it is pulled out from the casting mold. Thus, when delivered to the straightening section, only the surface portions of the strip have been solidified to form thin solidified shells, while the inner part of the same is still in molten condition.

When the straightening is effected on such a metal strip, strain is generated in the thin solidified shells to cause a cracking of the latter, resulting in an accident so-called "break-out" in which the inner molten metal flows out of the solidified shell through the cracks. The continuous casting work has to be stopped, once the break-out takes place. Conventionally, as a countermeasure for preventing the break-out, spray cooling has been effected on the metal strip pulled out from the casting mold, in which the metal strip is cooled by a coolant sprayed from a spray nozzle. However, unfortunately, this countermeasure is not effective enough to completely exclude the problem of break-out. As to the detail of this spray cooling technic, a reference shall be made to the specification of U.S. Pat. No. 3,623,535, although the latter is concerned with a technical subject entirely different from that of the present invention.

In the continuous casting of metal strips, it is essential to avoid the break-out attributable to the surface cracking of the metal strips, as will be realized from the foregoing description.

Besides that, there has been another problem of internal cracking which is often experienced in the course of the straightening. Although this internal cracking does not directly lead to a serious accident, this quality of the strip is often deteriorated fatally due to the presence of large internal cracks. In such a case, the strip cannot be sent to the next step of process, and has to be scrapped as being unacceptable. Practically, when the internal cracking is not so serious, the metal strip is subjected to a rolling before being sent to the cutting step, so that the small cavity caused by the internal cracking may be refilled.

This rolling step can be dispensed with, if the internal cracking during the straightening is completely avoided or, even if not, negligibly small. In addition, the use of the wheel-belt caster can be extended to the production of high quality steels in which the internal cracking is strictly prohibited.

However, no effective countermeasure has been taken or proposed to avoid the internal cracking, because the cause of the internal cracking has not been clarified.

SUMMARY OF THE INVENTION

It is therefore an object of the invention to provide a method of and apparatus for cooling and guiding a metal strip delivered from the casting mold of a continuous casting machine of the kind described, which would afford a straightening of the metal strip without causing the surface cracking and, accordingly, the break-out of the metal strip.

It is another object of the invention to provide a method of and apparatus for cooling and guiding a metal strip delivered from the casting mold of a continuous casting machine of the kind described, which would afford a straightening of the metal strip without being accompanied by the internal cracking of the metal strip.

It is still another object of the invention to provide a method of and apparatus for cooling and guiding the metal strip cast by the continuous casting machine of the kind described, which would render the casting machine of the kind described practically applicable to the production of strips of such metals having low thermal conductivity as steel.

It is a further object of the invention to provide a method of and apparatus for cooling and guiding the metal strip delivered from the casting mold of the continuous casting machine of the kind described, capable of straightening the metal strip without causing substantial wear down of guide members.

To these ends, according to the invention, there is provided a method of and apparatus for cooling and guiding a metal strip delivered from the casting mold of a continuous casting machine of a type called wheel-belt caster which has a casting wheel provided with a peripheral groove and an endless belt adapted to close a part of the circumferential length of the peripheral groove, such that the endless belt and the peripheral groove in combination constitute a casting mold, wherein said method and apparatus provide for gradually straightening the metal strip with the surface of the metal strip closer to the casting wheel cooled by a sheet of liquid coolant which flows on the surface and guided by a hydrostatic bearing of the coolant.

According to one aspect of the invention, the apparatus for cooling and guiding the metal strip in accordance with the invention comprises an wedge-shaped body which is disposed between the peripheral groove of the casting wheel and the upper surface of the metal strip delivered from the casting machine with its apex portion toward an outlet of the casting machine. This wedge-shaped body has a cooling and guiding surface of a gradually curved configuration. This cooling and guiding surface is made to confront the upper surface of the cast metal strip, when the wedge-shaped body is disposed between the casting wheel and the cast metal strip.

The wedge-shaped body may include a plurality of recesses formed in the cooling and guiding surface and a plurality of orifices opening in the recesses. Means are provided for supplying these orifices with a liquid coolant.

The wedge-shaped body may be provided with a header in communication with the orifice. The coolant supplied by the supplying means is received by and temporarily stored in the header, and then fed to the orifices.

Preferably, means are provided in the cooling and guiding apparatus of the invention for maintaining a predetermined distance between the surface of the metal strip and the cooling and guiding surface of the wedge-shaped body. This means may include a guide roller rotatably and adjustably mounted on the wedge-shaped body, so as to engage the surface of the metal strip.

The wedge-shaped body has, preferably but not exclusively, a plurality of orifices formed in the apex portion thereof. These orifices are in communication with the aforementioned header, and are adapted to direct jets of the coolant toward the outlet of the casting mold, substantially along the surface of the metal strip.

These and other objects, as well as advantageous features of the invention will become more clear from the following description of the preferred embodiments of the invention taken in conjunction with the accompanying drawings.

DESCRIPTION OF THE PREFERRED EMBODIMENTS

The present invention has been worked out on the basis of the results of intense study on the cause for the surface cracking , i.e. the break-out and the internal cracking of cast metal strips.

Before turning to the description of the preferred embodiments, the results of the study will be described for an easier understanding of the invention.

As explained previously, the surface cracking of the cast metal strip, which leads to the serious accidents of break-out, is caused by a straightening effected on the cast metal strip while the latter is solidified only at the surface portions thereof to form thin solidified shells, due to the poor heat conductivity of the metallic material, as in steel.

It has been confirmed that this surface cracking takes place in the surface of the metal strip closer to the casting wheel, which surface is subjected to a tensile force during the straightening. More specifically, the cast metal strip soon after the delivery from the casting mold tends to advance upward along the periphery of the casting wheel. However, the cast metal strip is prevented from moving upward, by pinch rolls disposed at the delivery side end of the casting mold which acts to forcibly pull laterally or horizontally, resisting the natural tendency of upward movement. Consequently, the cast metal strip is bent upwardly at a portion thereof just leaving the casting wheel. Due to the presence of this bend, such an excessively large tensile stress as can never be sustained by the solidified shell is caused in the surface of the cast metal strip closer to the casting wheel, i.e. in the upper surface of the metal strip.

Consequently, the solidified shell is broken to incur a danger of break-out.

It is therefore essential, for avoiding the break-out, to increase the mechanical strength of the solidified shell, especially at the surface of the metal strip closer to the casting wheel, and to effect the straightening gently and gradually, so as not to cause the upward bending of the metal strip when the latter leaves the casting wheel.

Concerning the internal cracking of the cast metal strip, it has been found out that the internal cracking is usually observed at a region relatively close to the surface of the metal strip closer to the casting wheel, i.e. to the upper surface of the cast metal strip, e.g. at a region of a depth of 8 to 15 mm from that surface of the metal strip. This means that the internal cracking takes place at a region which is subjected to a tensile stress during the straightening, rather than the portion in which the compression stress is generated.

This fact shows that the internal cracking of the metal strip is attributable to the following reasons.

Figure 1:
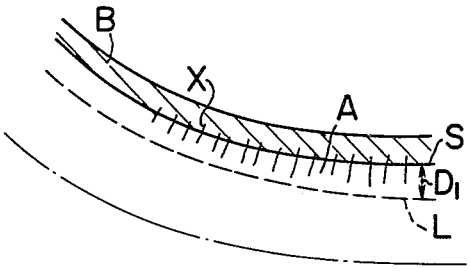
FIG. 1 is a sectional view of a part of a cast metal strip delivered from a casting mold of a continuous casting machine, showing an internal crack which may be caused when the metal strip soon after the delivery from the casting mold is straightened while being cooled by the conventional spray cooling.
Figure 2:
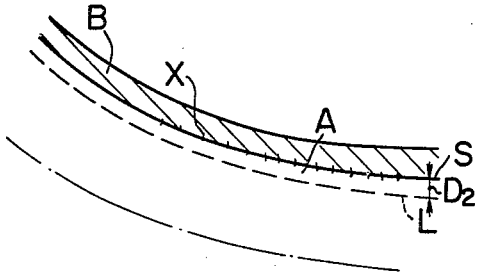
FIG. 2 is a view similar to that of FIG. 1 but showing an internal crack which may be caused when the metal strip soon after the delivery from the casting mold is straightened while being cooled by the apparatus in accordance with the invention.
Figure 3:
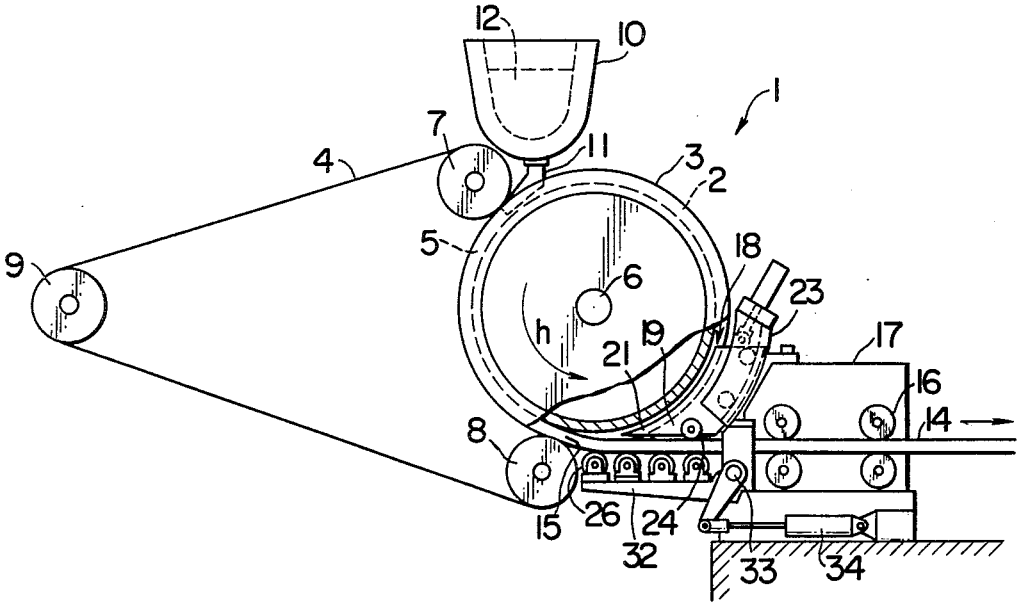
FIG. 3 shows, partly in section, a front elevation of a continuous casting machine incorporating a cooling and guiding apparatus embodying the present invention.

Referring to FIG. 1, the region between a liquidus line L (about 1510° C. in case of ordinary steel) and a solidus line S (about 1470° C. in case of ordinary steel) of the metal strip delivered from the casting mold has no substantial mechanical strength. As is well known to those skilled in the art, the ordinary steel exhibits a mechanical strength of substantially zero, at a temperature exceeding 1350° C. As the region A between the liquidus and solidus lines L and S is subjected to a tensile force, cracks, i.e. cavities x are generated in that region. Since the outer end of each cavity x is closed by the solidified shell B, the space of the cavity is kept under a substantial vacuum. Consequently, the molten or half solidified metal moves into the cavity x to refill the latter. However, the cavity x cannot be refilled completely, when the length of the cavity x is relatively large, so that a considerably part of the cavity is left unfilled. From this fact, it is derived that the internal crack is completely refilled by the molten metal, if the length of the initial internal crack is made sufficiently small. The length of the initial internal crack can be made small by reducing the thickness $D_1$ of the region A between the liquidus and solidus line L, S to $D_2$ as shown in FIG. 2.

This leads to a conclusion that, for preventing the internal cracking of the metal strip from taking place, it is essential to effectively cool the surface of the metal strip closer to the casting wheel.

On the basis of these conclusions of the study, the present invention contemplates a method of and apparatus for cooling and guiding the cast metal strip delivered from the continuous metal strip, wherein a gentle and gradual straightening of the metal strip is effected with the surface of the metal strip closer to the casting wheel cooled by a sheet of liquid coolant which flows on the surface and guided by a hydrostatic bearing of the liquid coolant.

It has been proved and confirmed that a higher cooling effect can be brought about by the flowing sheet of liquid coolant than by the spray cooling. More specifically, in case of the spray cooling, the pressure of the coolant is inconveniently attenuated until it reaches the surface of the metal strip, even when the spray is effected at an elevated pressure, so that the coolant cannot break and penetrate the film of vapor formed on the surface of the metal strip. This film of vapor acts as a heat insulator, so as to draw a line of practical limit of the cooling effect. In sharp contrast to the above, the flowing sheet of liquid coolant ensures an enhanced cooling effect, because the film of the vapor is broken and erased out by the coolant having a hydrostatic pressure.

Referring now to FIGS. 3 to 7 showing a preferred embodiment of the invention, a continuous casting machine generally denoted by a reference numeral 1 has a casting wheel 3 provided with a peripheral groove 2. The peripheral groove 2 is closed over a part of its circumferential length by an endless belt 4. The peripheral groove 2 and the endless belt 4 in combination constitute a casting mold 5. The casting wheel 3 is adapted to be rotated in the direction of an arrow h about the axis of a shaft 6. The endless belt 4 closing the peripheral groove 2 of the casting wheel 3 is adapted to run in synchronization with the casting wheel 3, going round an upper belt guide roller 7, a lower belt guide roller 8, a belt tension roller 9 and then along the periphery of the casting wheel 3.

A tundish 10 is disposed at the upper side of the casting wheel 3. The tundish 10 has a nozzle 11 at its bottom through which a molten metal 12 is poured into the casting mold 5. The molten metal is supported by the portion of the endless belt 4 contacting the outer periphery of the casting wheel 3, and is effectively cooled by a coolant, which is preferably water, flowing in contact with the back side surface of the endless belt 4. Also, the inner surface of the molten metal 12 contacting the peripheral groove 2 of the casting wheel 3 is cooled by the cooling water which flows along the outer portion of the casting wheel 3. As the moltent metal filling the casting mold 5 is gradually cooled in the described manner, the surface areas of the molten metal becomes solidified to form solidified shells 13 (See FIG. 5). The thickness of the solidified shells grows larger as the molten metal is conveyed by the rotating casting mold, and is pulled out continuously as a cast metal strip 14 through an outlet 15 of the casting mold 5, by means of pinch rolls 16 carried by a frame 17.

Figure 4:
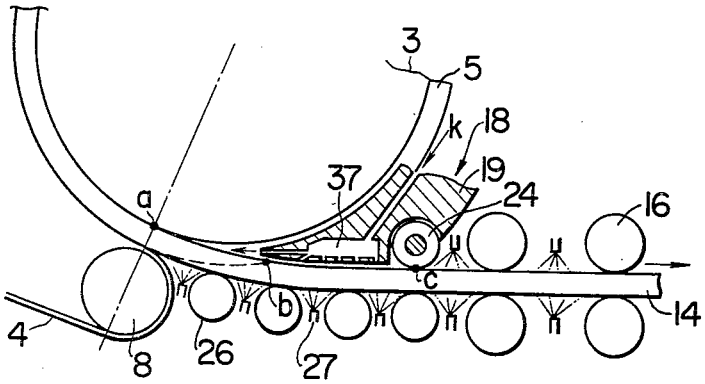
FIG. 4 is a partially sectioned enlarged view of the cooling and guiding apparatus and its associated members incorporated in the continuous casting machine as shown in FIG. 3.
Figure 5:
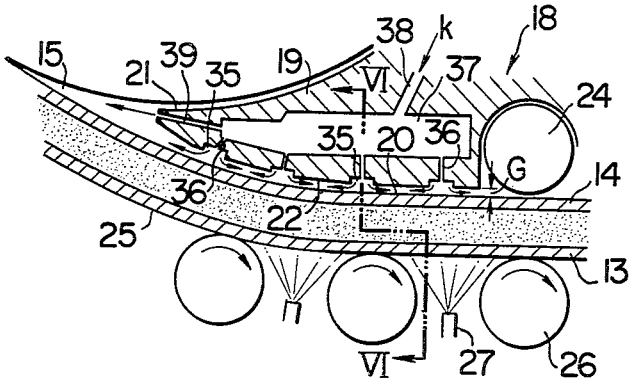
FIG. 5 is a view similar to that of FIG. 2 showing the manner of internal solidification of the cast metal strip and illustrating in a larger scale the cooling and guiding apparatus and associated members of the continuous casting machine of FIG. 3, to show the construction of a wedge-shaped body of the apparatus and the flow of the coolant.

A straightening section defined between the outlet 15 of the casting mold 5 and the pinch rolls 16 incorporates a cooling and guiding apparatus 18, which constitutes the essential feature of the invention and is shown in detail in FIGS. 4 and 5.

The arrangement is such that the cast metal strip 14 delivered from the outlet 15 of the casting mold 5 is gradually straightened in this straightening section with the upper surface of the metal strip cooled by a sheet of liquid coolant which flows on the surface and guided by a hydrostatic bearing of the liquid coolant, by means of the cooling and guiding apparatus 18.

A substantially equi-spaced correction rollers 26 are disposed beneath the cooling and guiding apparatus 18. These correction rollers 26 are adapted to assist the cooling and guiding apparatus 18 in straightening the metal strip 14, upon direct contact with the lower surface 25 of the latter delivered from the casting mold 5.

Between the adjacent corrections rollers 26, disposed are spray nozzles 27 adapted to effect a spray of a coolant to cool the lower surface 25 of the metal strip 14.

Figure 6:
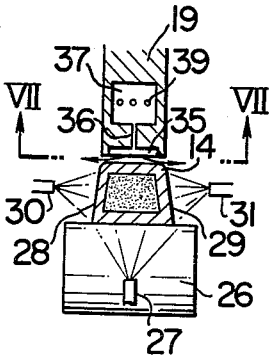
FIG. 6 is a sectional view taken along the line VI—VI of FIG. 5.

As will be seen from FIG. 6, spray nozzles 30, 31 are disposed at opposite lateral sides of the metal strip 14 so as to cool the lateral end surfaces 28, 29 of the metal strip 14.

The correction rollers 26 are fixedly mounted on a support frame 32 which in turn is rotatably carried by a shaft 33. The shaft 33 is adapted to be rotated by a hydraulic piston means 34, so as to swing the correction rollers 26, thereby to bring the rollers 26 into and out of engagement with the cast metal strip 14.

Hereinafter, a description will be made as to the detail of the cooling and guiding apparatus 18 which constitutes the critical feature of the invention.

The apparatus 18 has a wedge-shaped body 19 disposed between the peripheral groove 2 of the casting wheel 3 and the upper surface 20 of the metal strip 14 delivered from the casting mold 5, with its apex portion 21 directed toward the outlet 15 of the casting mold 5. As illustrated, the wedge-shaped body 19 has a gradually curved cooling and guiding surface 22, which is adapted to confront or face the upper surface 20 of the metal strip 14 when the wedge-shaped body is correctly disposed between the metal strip 14 and the casting wheel 3.

The wedge-shaped body 19 is attached to a guide frame 23 which in turn is mounted on the frame 17 carrying the pinch rolls 16, by suitable fastening means (not shown). The arrangement is such that the wedge-shaped body 19 can be moved up and down, with respect to the guide frame 23, when the fastening means are removed.

A guide roller 24 secured to the lower portion of the wedge-shaped body 19 is adapted to engage the upper surface 20 of the metal strip 14, so as to preserve a suitable gap G between the upper surface 20 of the metal strip 14 and the cooling and guiding surface 20 of the wedge-shaped body 19. The gap G can be adjusted by replacing the guide roll 24 with other rolls having different diameters or by shifting the position of the axis of rotation of the guide roll 24.

A plurality of relatively shallow recesses 35 are formed in the cooling and guiding surface 22 of the wedge-shaped body 19. A plurality of orifices 36 are formed in the wedge-shaped body 19, such that one orifice opens in each recess 35 substantially at the center of the latter. The arrangement is such that a liquid coolant, which is preferably water, supplied in a controlled manner from an external coolant supplying means (not shown) is jetted through the orifices 36 into respective recesses 35. It will be seen that a flowing sheet of liquid coolant and a hydrostatic bearing guide can be applied to the upper surface 20 of the metal strip, by the coolant jetted into the recesses 35 from the orifices 36, provided that the gap G between the upper surface 20 of the metal strip and the cooling and guiding surfaces is suitably set and maintained.

The gap G is preferably about 0.2 to 3 mm and more preferably about 0.5 to 2.0 mm, when the economical use of the coolant is taken into consideration.

Figure 7:
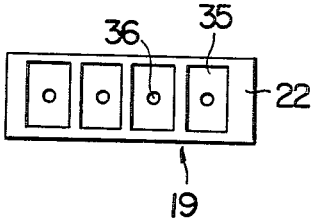
FIG. 7 is a view taken along the line VII—VII of FIG. 6, showing a cooling and guiding surface of the wedge-shaped body.

In order that the larger area of the upper surface 20 may be subjected to the hydrostatic pressure of coolant the recesses 35 of the cooling and guiding surface 22 are made to have a relatively large area, as shown in FIG. 7. Additionally, the orifice 36 may be in form of a slit.

The wedge-shaped body 19 is preferably provided with a header 37 formed therein, so that the coolant supplied by the supplying means is received by and temporarily stored in the header 37 before being sent to the orifices 36. By doing so, a hydrostatic pressure of the coolant is established in the header 37, so as to enable the orifices 36 to discharge the coolant into respective recesses 35 in a stable pressurizing condition, thereby to ensure a stable hydrostatic bearing effect without pressure fluctuation on the upper surface 20 of the metal strip 14.

At the same time, a plurality of orifices 39 are formed at the apex portion 21 of the wedge-shaped body 19. These orifices 39 are adapted to jet the coolant onto the area of the upper surface 20 of the metal strip 14 between the apex 21 and the outlet 15 of the casting mold 5, substantially along the surface 20. As is the case of the orifices 36, the orifices 39 are in communication with the header 37, so as to be supplied with the coolant from the common coolant supplying means to that for the orifices 36. This arrangement for the coolant supply is preferred, although not exclusive, from a view point of simplification of the construction. The orifice 39 may be in form of slit.

In operation, the portion of the cast metal strip 14 delivered from the casting mold 5 is contacted and guided at its lower side by the correction rolls 26 and cooled from the same side by the spray of the coolant effected by the spray nozzle 27, before the portion of the strip reaches the pinch rolls 16. At the same time, the both lateral end surfaces 28, 29 of the metal strip 14 are cooled by the spray of the coolant effected by the spray nozzles 30, 31. Thus, the cooling of the lower side and the both lateral end portions of the metal strip 14 are made in the same manner as the conventional cooling method. These cooling arrangements same as the conventional one are adopted because the surface cracking and the internal cracking take place, as previously explained, in the upper surface 20 or in a portion close to the upper surface 20 of the metal strip where a large tensile stress is caused, so that no strong cooling effect is necessary for the lower side and both lateral sides of the metal strip, and because it is possible to preserve a space large enough to accommodate the spray nozzles at the lower side and the lateral sides of the metal strip.

Meanwhile, the upper surface 20 of the metal strip 14 is effectively cooled and smoothly guided by the cooling and guiding means 18, as it is transferred to the position of the pinch rolls 16. More specifically, the portion of the upper surface 20 passing through a section between the outlet 15 of the casting mold 5 and the apex 21 of the wedge-shaped, body 19, i.e. the section a-b as shown in FIG. 4, is cooled by the coolant jetted at a high velocity from the orifices 39 of the apex 21. At this portion of the metal strip 14 reaches and passes the section b-c beneath the cooling and guiding surfaces 22, the portion of the metal strip is gradually straightened along the curvature of the cooling and guiding surface 22, during which the portion of the strip is forcibly cooled by a flowing sheet of liquid coolant jetted into the recesses 35 through the orifices 36, and guided by the hydrostatic bearing constituted by the same coolant.

As mentioned before, a forcible cooling and a smooth guiding of the surface closer to the metal strip 14 delivered from the casting mold 5 are essential and critical. It is to be noted that, according to the invention, this forcible cooling and smooth guiding is achieved by the cooling and guiding apparatus 18.

The body portion 19 of the cooling and guiding apparatus 18 of the described embodiment affords, due to its wedge-shaped configuration, to locate its cooling and guiding surface 22 in the close proximity of the outlet 15 of the casting mold 5. At the same time, since the cooling and guiding surface 22 has a gradually curved configuration, the straightening of the metal strip as the latter passes the section a-c is performed gently and gradually.

At the same time, the upper surface 20 of the portion of the metal strip at the lower side of the cooling and guiding surface 22 is cooled by the flowing sheet of the coolant and guided by the hydrostatic bearing. Thus, the upper surface 20 of the metal strip is gradually straightened without making a direct contact with the cooling and guiding surface 22, due to the presence of the hydrostatic bearing, and forcibly and effectively cooled by the flowing sheet of the coolant. Consequently, the problem of wear down of the guiding surface is avoided almost completely.

It is to be noted that the cooling effect or power of the flowing sheet of liquid coolant can easily be adjusted by varying the flow velocity W of the coolant. More specifically, representing the cooling power by a heat transfer coefficient $\alpha$, the following equations are established for the cooling effect of the flowing sheet of liquid coolant.

$$\alpha \mathrm{Kcal}/m^2h^\circ\mathrm{C.} = 2900 \times W^{0.85}(1+0.01\theta w)$$

where,

W represents the flow velocity of the coolant (m/s) while $\theta_w$ is the temperature of the coolant.

Thus, the heat transfer coefficient $\alpha$ is determined by the temperature and the flow velocity of the coolant, and is given as a function of only the flow velocity, provided that the temperature of the coolant is kept constant.

It is well known that a heat transfer coefficient exceeding 2000 to 3000 Kcal/m$^2$h°C. can hardly be obtained by the spray cooling as performed by the spray nozzles 27, 30, 31. In good contrast to the above, the flowing sheet of coolant as adopted in the cooling method of the invention can provide a much larger heat transfer coefficient well reaching 6700 Kcal/m$^2$h°C., provided that the flow velocity W of the cooling water is maintained at 2 m/sec.

A good effect was confirmed through experiments conducted under the condition of the flow velocity of 3 m/sec., pressure of the coolant of 5 Kg/cm$^2$ and the gap G between the cooling and guiding surface and the metal strip of 0.5 mm.

Further, when the cooling and guiding apparatus 18 of the described embodiment is used, the upper surface 20 of the portion of the metal strip immediately after leaving the outlet 15 of the casting mold 5 can be also cooled effectively, by the coolant jetted from the apex portion of the wedge-shaped body. The effect of this cooling is much larger than that performed by the conventional spray cooling, thanks to a hydrostatic pressure of the coolant generated by the jetting flow of the coolant which is forcibly applied to a limited space defined by the casting wheel, metal strip and the wedge-shaped body.

Figure 8:
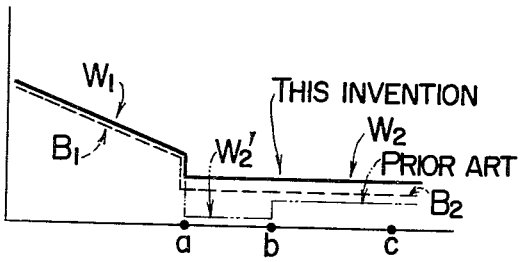
FIG. 8 is a graphical representation of the heat transfer coefficient between the cast metal strip and the coolant obtained by the cooling and guiding apparatus of the invention, in comparison with that obtained by the cooling by the conventional spray cooling.

FIG. 8 shows how largely the heat transfer coefficient $\alpha$ is improved by the described embodiment of the invention. The symbols a, b and c correspond, respectively, to the points a, b and c in FIG. 4. The full-line curve $W_2$ shows the cooling power or effect on the upper surface 20 of the metal strip 14 delivered from the casting mold 5, achieved by the cooling method of the invention, while two-dots-and-dash-line curve $W_2'$ shows the cooling power effected on the same surface 20 by the conventional spray cooling. The full-line curve $W_1$, broken line curve $B_1$ and the broken line curve $B_2$ respectively show, by way of reference, the cooling power effected by the conventional cooling technic on the casting wheel-side surface of the metal strip in the casting mold 5, the cooling power performed by the conventional cooling technic on the belt-side surface of the metal strip in the casting mold 5, and the cooling power of the spray cooling effected on the lower surface of the metal strip 14 delivered from the casting mold 5.

Apart from the present invention, Japanese Patent Publication No. 23326/1977 discloses a technic concerning the straightening of the metal strip delivered from the casting mold. According to this technic, the position where the cast metal strip leaves the peripheral groove of the casting wheel (this point corresponds to point a of FIG. 7) is located at the upstream side of the bottom center of the peripheral groove of the casting wheel, while the position at which the straightening of the metal strip is completed (this point substantially corresponds to the point c of FIG. 4) is located at a level below the level of the bottom center of the peripheral groove, so that the rate of the straightening may be eased to avoid the surface and internal crackings of the metal strip, and so as to make the most of the effect of the sinkhead.

Thus, the described embodiment is preferably modified making use of the above stated technical idea. In such a case, the wedge-shaped body 19 is located such that the point a at which the cast metal strip leaves the peripheral groove 2 of the casting wheel 3 is positioned at the upstream side of the bottom dead center of the peripheral groove, while the point c at which the straightening is completed is positioned at a level lower than that of the peripheral groove of the casting wheel. This modification affords a more smooth straightening, contributing greatly to avoid the surface cracking, i.e. the break-out, and the internal cracking of the metal strip.

From the foregoing description of the preferred embodiment, it will be seen that the following advantageous effects are derived from the method and apparatus of the invention.

(a) According to the invention, the break-out accident attributable to the local bending of the metal strip, which could have been hardly overcome by the conventional technic, can fairly be avoided by cooling the surface of the metal strip closer to the casting wheel by a flowing sheet of liquid coolant and guiding the surface by a hydrostatic bearing.

(b) The internal cracking of the metal strip can be made smaller, thanks to much larger cooling effect ensured by the flowing sheet of liquid coolant. Consequently, the quality of the final products is greatly improved.

(c) The cooling and guiding apparatus can be placed in the close proximity of the delivery side end of the casting mold, thanks to the wedge-shaped configuration of its body, so that a more effective cooling can be performed.

(d) The portion of the cast metal strip immediately after leaving the delivery side end of the casting mold can effectively be cooled by the high speed flow of the coolant jetted from the apex portion of the wedge-shaped body. This considerably contributes to avoid the internal cracking of the metal strip.

(e) The straightening and cooling of the cast metal strip by the method and apparatus of the invention can be carried out quite easily.

(i) Conventionally, the continuous casting machines of the kind described have been used specifically for those materials having relatively large thermal conductivities such as copper and aluminum. However, according to the invention, this type of continuous casting machine is conveniently rendered applicable to the production of steel strips. That is, the advantages inherent in the wheel-belt caster can be expected also in the casting of the steel strips.

What is claimed is:

1. A method of cooling and guiding a strip of metal as it moves through a straightening section of a continuous casting machine of the wheel-belt caster type, comprising the steps of:

rotating a casting wheel having a peripheral groove simultaneously with moving an endless belt in contact with only a portion of the peripheral groove so as to form an arcuate casting mold with an inlet opening for receiving molten metal and an outlet opening for discharging a partially solidified strip of metal;

pouring molten metal into the inlet opening of the arcuate casting mold continuously, while continuously withdrawing the partially solidified strip of metal from the outlet opening of the arcuate casting mold so that the molten metal is partially solidified as it travels through the arcuate casting mold, and the strip of metal is bent from the arcuate shape of the casting mold to a linear shape within a straightening section defined between the outlet opening of the casting mold and the point at which the strip shape is linear; and cooling and guiding the surface of the strip that was radially innermost in the arcuate casting mold throughout a major portion of the straightening section by contacting said surface with a sheet of liquid coolant that is confined and supplied so as to form a hydrostatic bearing of the liquid coolant along a major portion of said surface within the straightening section as the metal strip is gradually straightened.

2. The method according to claim 1, wherein said last mentioned step provides a hydrostatic pressure over substantially the entire said surface within said straightening section, and includes the step of injecting and confining a stream of liquid coolant generally tangentially with respect to the casting wheel into the nip formed between the casting wheel and strip at said outlet opening.

3. The method of claim 2, including:

providing a rigid wedge-shaped body between the strip and casting wheel within said straightening section, with a curved surface facing said surface of the strip and having liquid coolant supplying and confining means in its said surface for forming the hydrostatic bearing; and engaging a roller with said surface of the strip at the downstream end of said straightening section along a line contact that is spaced, in the direction away from said casting wheel, from an extension of the curved surface of the wedge-shaped body a fixed amount for determining the thickness of the hydrostatic bearing between said surface of said strip and said surface of said wedge-shaped body.

4. The method of claim 1, including:

providing a rigid wedge-shaped body between the strip and casting wheel within said straightening section, with a curved surface facing said surface of the strip and having liquid coolant supplying and confining means in its said surface for forming the hydrostatic bearing; and engaging a roller with said surface of the strip at the downstream end of said straightening section along a line contact that is spaced, in the direction away from said casting wheel, from an extension of the curved surface of the wedge-shaped body a fixed amount for determining the thickness of the hydrostatic bearing between said surface of said strip and said surface of said wedge-shaped body.

5. A continuous casting machine, comprising:

a rotatably mounted casting wheel having a continuous peripheral groove;

an endless belt mounted for movement along a path having a portion in contact with an arcuate portion of the casting wheel so as to close a corresponding portion of the length of said groove to form therebetween an arcuate casting mold with an inlet opening for receiving molten metal and an outlet opening for discharging a partially solidified strip of metal;

means for guiding the strip of metal along a linear path away from said casting wheel so as to form a straightening section between said means for guiding and said outlet opening wherein the strip of metal bends from the arcuate shape of said arcuate casting mold to a linear shape;

a body mounted between the strip and casting wheel within the straightening section, having a surface immediately adjacent the surface of the strip that was radially innermost within said arcuate casting mold, and means for passing liquid coolant through said body surface into contact with said strip surface;

means for confining the supplied liquid coolant in a liquid sheet between said body surface and said strip surface and means to supply the liquid coolant at a flow through said body surface sufficient to produce a hydrostatic bearing between said body and said strip surface throughout a major portion of the length of said strip within said straightening section for simultaneous cooling, guiding and supporting of said strip as it is gradually straightened from the arcuate shape of said casting mold to a linear shape.

6. The apparatus of claim 5, wherein said body is wedge-shaped with an apex facing said mold outlet opening.

7. The apparatus according to claim 6, including orifice means within said apex portion for discharging a stream of liquid coolant generally tangentially of said casting wheel toward said mold outlet opening into the nip between said strip and casting wheel at a flow rate sufficient to form a hydrostatic pressure of the coolant in the limited space defined by said strip surface, said casting wheel and said apex portion.

8. The apparatus according to claim 7, wherein said body surface is curved.

9. The apparatus according to claim 8, wherein said means to supply includes a plurality of recesses formed in said body surface, a liquid plenum chamber within said body, a plurality of liquid passages opening into said plenum chamber at one end and respectively opening into said recesses at their other ends, and a supply conduit for supplying liquid coolant to said plenum chamber.

10. The apparatus of claim 5, further including rigid means contacting said strip surface adjacent said body and at a fixed spacing from an extension of said body surface so as to maintain a fixed gap between said body surface and said metal strip to determine the thickness of the hydrostatic bearing.

11. The apparatus according to claim 10, wherein said last mentioned means is a roller mounted for rotation about an axis and in engagement with said strip surface, and means adjustably mounting said roller for movement of its axis toward and away from the extension of said body surface to correspondingly adjust the thickness of the hydrostatic bearing.

12. The apparatus according to claim 5, wherein said body is wedge-shaped with an apex facing said mold outlet opening and said body surface is curved.

13. The apparatus according to claim 12, wherein said means to supply includes a plurality of recesses formed in said body surface, a liquid plenum chamber within said body, a plurality of liquid passages opening into said plenum chamber at one end and respectively opening into said recesses at their other ends, and a supply conduit for supplying liquid coolant to said plenum chamber.

14. The apparatus according to claim 5, wherein said body surface is curved.

15. The apparatus according to claim 5, wherein said means to supply includes a plurality of recesses formed in said body surface, a liquid plenum chamber within said body, a plurality of liquid passages opening into said plenum chamber at one end and respectively opening into said recesses at their other ends, and a supply conduit for supplying liquid coolant to said plenum chamber.

* * * * *